United States Patent [19]

Mourier

[11] 4,306,174

[45] Dec. 15, 1981

[54] RADIO WAVE GENERATOR FOR ULTRA-HIGH FREQUENCIES

[75] Inventor: Georges Mourier, Paris, France

[73] Assignee: Thomson-CSF, Paris, France

[21] Appl. No.: 106,485

[22] Filed: Dec. 26, 1979

[30] Foreign Application Priority Data

Dec. 29, 1978 [FR] France ..... 78 36960

[51] Int. Cl.[3] ..... H01J 25/00

[52] U.S. Cl. ..... 315/4; 315/3; 315/5

[58] Field of Search ..... 315/3, 4, 5

[56] References Cited

U.S. PATENT DOCUMENTS

| | | | |
|---|---|---|---|
| 3,218,503 | 11/1965 | Adler | 315/3 |
| 3,353,053 | 11/1967 | Bott | 315/4 X |
| 3,457,450 | 7/1969 | Feinstein et al. | 315/5 |
| 3,463,959 | 8/1969 | Jory et al. | 315/5 |
| 4,199,709 | 4/1980 | Alirot et al. | 315/4 |
| 4,200,820 | 4/1980 | Symons | 315/4 |

FOREIGN PATENT DOCUMENTS

| | | | |
|---|---|---|---|
| 672 | 6/1978 | France | 315/4 |

*Primary Examiner*—Saxfield Chatmon, Jr.
*Attorney, Agent, or Firm*—Roland Plottel

[57] ABSTRACT

An electron beam transmitted in the direction of an axis XX is subject to the action of a magnetic field, which is constant in time and directed along the axis XX, as well as to the electromagnetic field of resonant cavities placed along its path. These cavities are excited at the cyclotron frequency of the electrons in the field by a source coupled by an antenna. Output power, at a frequency which is near a multiple of the cyclotron frequency, is collected by a second antenna and coupled to a load. In one example, the cavities comprise a single guide, whose circular cross-section has been deformed so as to provide two extensions.

2 Claims, 4 Drawing Figures

FIG_1-a
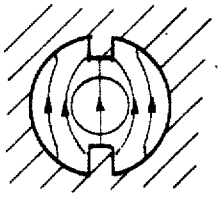
FIG_1-b
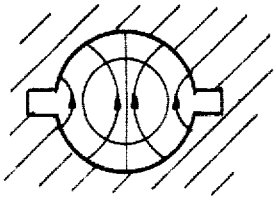
FIG_1-c
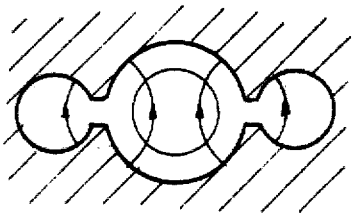
FIG_2
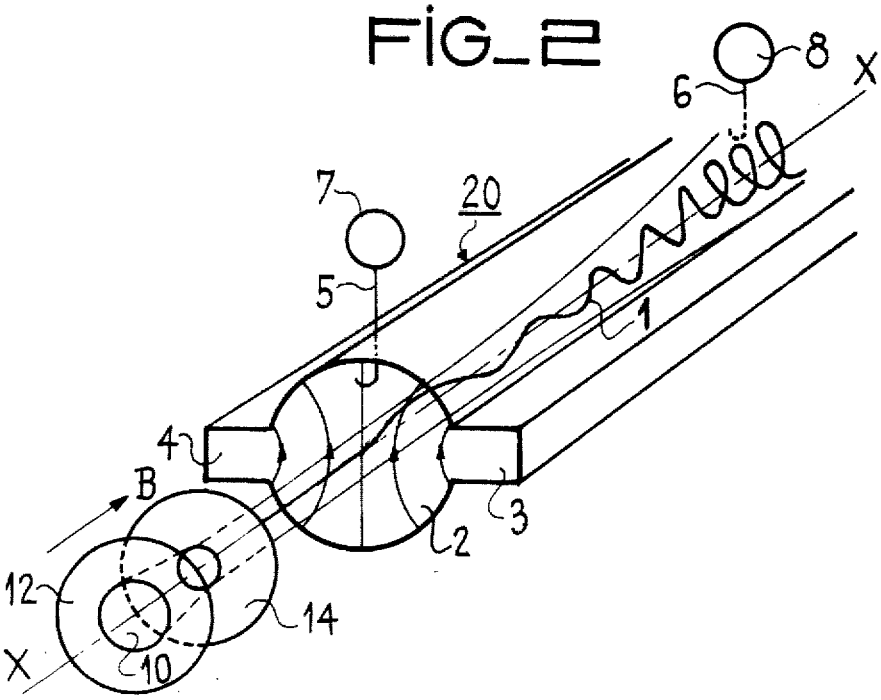

RADIO WAVE GENERATOR FOR ULTRA-HIGH FREQUENCIES

BACKGROUND OF THE INVENTION

The invention relates generally to ultra high frequency radio wave generators and more specifically to generators operating at the top of this range, namely at a few dozen gigahertz, i.e. in the millimeter and submillimeter wave bands.

Several types of electron tubes for this use are known from the prior art. In one type, an electron beam advances along an axis where it is subject to the action of a uniform magnetic field, which is constant in time and directed along this axis, as well as to that of a high frequency electrical field directed transversely with respect to the field and whose frequency is equal to the cyclotron frequency of the electrons in the magnetic field in question.

In tubes of this type the electrons are produced by a device which inparts thereto a velocity component which is directed transversely to the axis. This device is generally an electron gun, whose cathode is in the form of a ring and produces a hollow cylindrical beam.

The high frequency electrical field comprises the electrical component of the electromagnetic field occurring within resonant cavities that are placed along the path of, and are coupled to, the beam.

Under these conditions the electrons travel along the axis in spiral paths and during the last part of their travel are able to transfer radio energy at the electromagnetic field frequency, or a multiple thereof, as a result of alternating high frequency components formed within the beam in the first part of the path. The radio energy produced at this frequency is collected in one or more loads coupled to the final resonant cavity.

In the prior art tubes the energy is supplied to the electrons solely by the direct current supply which accelerates them, there being no other energy source in the system.

Over the past few years developments have taken place in connection with this type of tube, and information on these is provided in the report by V. A. FLYAGIN, A. V. GAPONOV, M. I. PETELIN, V. K. JULPATOV "The Gyrotron" Second International Conference and Winter School on Submillimeter Waves and their Applications. Dec. 6–11, 1976—Puerto-Rico.

Thus, these tubes are characterised by the high values of the accelerating direct voltage applied to the beam in order to give the beam the desired high energy. They are also characterised by high intensity magnetic fields. It is known that the intensity of the magnetic field B and the cyclotron frequency $f_c(\omega_c=2\pi f_c)$ are two proportional magnitudes: $\omega_c=eB/m_o$, e and $m_o$ representing respectively the charge and mass of the electron at rest.

However, the application of high direct voltages comes up against insulation difficulties in the case of these wavelengths where very small circuits are used. The application of the necessary magnetic fields generally leads to the use of superconducting circuits if the necessary values are to be reached, which exceed the maximum values attainable under normal conditions, but it is known that the construction and utilisation of such circuits are difficult.

BRIEF SUMMARY OF THE INVENTION

The invention relates to a millimeter wave generator of the type, to which reference has been made hereinbefore and, which uses a longitudinal magnetic field and a high frequency electrical field, whose lines of force are arranged transversely thereto, making it possible to reduce the above-indicated difficulties.

To this end a generator according to the invention is subdivided into two sections which follow one another along the axis. In the first, by which the beam enters, the resonant cavities have a resonant frequency equal to the cyclotron frequency of the electrons in the magnetic field B. These cavities are supplied with high frequency by a wave at the cyclotron frequency $f_c$. In the second section, which resonates at a multiple or harmonic frequency $nf_c$ of the latter (n being the rank of the harmonic) energy sampling takes place. As a result of this arrangement part of the energy is transferred to the electrons by the high frequency electrical field in the first section. It is therefore possible, all things being equal, to reduce the direct voltage applied to the beam and to reduce the attendant difficulties.

The generator according to the invention is in the form of a two-section system, one of which has an accelerating function in which a high frequency field of frequency $f_c$ transfers energy to the electrons, while the other has a collecting function in which part of the energy of these electrons is sampled or picked up. In other words the device according to the invention is in the form of a generator on frequency $nf_c$ in which has been incorporated a low frequency accelerator $f_c$. The significance of energy transfer to the electron beam on this low frequency is that in general such transfers have a higher efficiency at low frequency.

The magnetic field applied has an intensity corresponding to the cyclotron frequency $f_c$ and consequently is also reduced compared with that which would necessitate the frequency $nf_c$.

Finally, unlike the prior art there is no need to provide in the generators according to the invention an electron gun arrangement making it possible to impart a transverse velocity to the electrons, namely as already stated an annular electron gun. This transverse velocity is applied in the generator according to the invention by the high frequency field occurring in the first section.

These possibilities constitute advantages of the invention compared with the prior art.

As will be seen the resonant cavities of the two sections can, within the scope of the invention, be integral parts of one and the same resonant enclosure.

BRIEF DESCRIPTION OF THE DRAWINGS

The invention is described in greater detail hereinafter relative to non-limitative embodiments and the attached drawings, wherein show:

FIG. 1 examples of wave guide sections used in the generators according to the invention.

FIG. 2 a general diagrammatic view of a generator according to the invention.

DETAILED DESCRIPTION OF THE PREFERRED EMBODIMENTS

In generators of this invention using a crossed magnetic field and high frequency electrical field, operation is effectively possible with a harmonic of the cyclotron frequency. For this operation to be sufficiently efficient it is necessary for the high frequency field to have a high amplitude at the harmonic.

According to an embodiment of the invention the single resonant cavity is selected so that it has high amplitude space harmonics at the desired operating frequency. To this end the resonant cavity is on ultra-high frequency wave guide, which resonates on the cyclotron frequency and whose cross-section is deformed or shaped in order to favor the presence of these harmonics in the configuration of the electromagnetic field occurring therein.

Such a guide is of the type used in ultra-high frequency and has a regular cross-section, whose dimensions are large compared with the wave length of the wave to be produced. It permits the use of a cylindrical beam, which is easy to produce, and which is transmitted along its axis. The fields are of small amplitude, along and in the vicinity of, the axis due to the dimensions of the guide. Due to the shape of the cross-section of the guide it is possible to localise the lines of force of the space harmonics in such a way that their amplitude, in the region of the beam, is high enough for an effective interaction between the electron beam and its harmonics.

An example of the guide shape, or deformations of an originally circular guides follows. This example is given in a non-limitative manner for illustration of one embodiment of the invention, it being stressed that other guide configurations and in particular rectangular guides may also be used.

FIGS. 1*a*, 1*b*, and 1*c* show certain configurations having high amplitude space harmonics at the frequency $nf_c$ in a circular guide. The lines with the arrows represent the lines of force of the electrical field having a high value component on harmonics 3 and 5 in mode $TE_{10}$.

The beam is transmitted in this guide under the action of a high direct voltage applied between a cathode (at which it is produced) and an anode placed in front of it. This high voltage supplies the beam with part of its energy in the longitudinal direction. The other part is supplied in the transverse direction, by a high frequency electrical field in the wave guide. The guide is at the voltage of the anode, with which it forms an equipotential space, and into which the beam is introduced by means known in the art (and which will not be described). Under operating conditions the beam describes a spiral path, whose radius increases as the beam advances and as it acquires energy. This path follows a surface of generally conical shape circling about the axis of the system, which coincides with that of the magnetic field. It can be likened to a series of successive circular windings, whose radius increases approximately linearly as a function of the length the axis, and each described in a time equal to the cyclotron cycle of the field B. This path must remain entirely within the wave guide.

A comparison may be made between the minimum radius a required on mode $TE_{10}$ by the guide used in order to be able to function at the cyclotron angular frequency $\omega_c$, i.e. the value of the radius corresponding to the cut-off at this frequency, and the radius r of the path of the electrons at their maximum energy.

In this evaluation it is accepted that all the energy of the electrons is imparted by the high frequency electrical field. This is only made to permit this evaluation. It is also assumed that the energy transmitted to the electrons by the high frequency field is 50 keV above their energy at rest, i.e. an increase of one tenth.

Thus, under these conditions we obtain $$1 + \frac{\Delta W}{Wo} = (1 - \beta_t^2)^{-\frac{1}{2}},$$

Wo representing the energy of the electron at rest, and $\Delta W$ its energy gain on its path. $\beta t$ represents the relativistic factor equal to the ratio $v_t/c$ of the velocity, in this case entirely transverse velocity, of the electron to that of the light, gives $v_t/c = \omega_c r/c$.

The radii a and r are related to the wave length $\lambda_o$ corresponding to the harmonic. For example for $n=3$, the ratio $2\pi(r/\lambda_o)$ is equal to 1.238, while the one corresponding to the radius a, i.e. $2\pi(a/\lambda_o)$ equals 1.841.

Thus, the radius of the guide is much larger than the maximum radius of the path. The guide is then deformed to obtain space harmonics on the oscillation $n\omega_c$ therein.

The wave generator of this one embodiment of the invention is shown in FIG. 2.

An electron beam 1 is directed along an axis XX of a wave guide 20 having a circular cross-section 2, and two diametrically opposite extensions 3, 4 of rectangular cross-section. These lateral spaces preferentially guide a harmonic of the frequency of the guide on mode $TE_{10}$. The field lines of the electrical component of the mode in question are shown by arrows.

A magnetic field B (arrow) is directed longitudinally along axis XX of the guide. An oscillator 7 excites the guide at oscillation $\omega_c$ equal to the cyclotron oscillation of the electrons of the beam in magnetic field B. This oscillator 7 is coupled to the guide by an antenna 5, which is diagrammatically indicated by its loop. A second antenna, diagrammatically shown at 6, collects the power produced in the guide at frequency $n\omega_c$. The drawing schematically shows part of the path of beam 1. Antenna 6, is placed at the level of the last turn of the beam; and in a device is placed further away than is shown in FIG. 2. This follows from the numerical example. The electron beam is produced by a gun having a circular cathode 10, a pierce electrode 12 and an anode 14 accelerating the beam.

Under these conditions the electrons transfer high frequency energy to a load 8 coupled to the output antenna 6. The energy which the electrons receive is in a continuous and high frequency form and places them under relativistic conditions, i.e. such that their mass variation resulting from the increase in their energy in the accelerating section leads to a variation of their phase compared with the electromagnetic field. At these velocities it should be noted that the moving electron is able to transfer energy to a high frequency electromagnetic field. This applies to values of the oscillation or angular velocity $\omega_s$ of the electrons within a certain range about the oscillation of the electromagnetic field with which they interact. In the generators according to the invention this can lead to the use of a magnetic field, whose intensity varies, with the abscissa, along the axis XX.

The generator according to the invention may be liken to a high power frequency multiplier. It is pointed out that it is not a question of multiplication of the cyclotron oscillation $\omega_c$ by the factor n, but instead multiplication by a factor differing slightly from n, because the condition $\omega_s = n_c$ is not strictly fulfilled.

Hereinafter are given three examples of operating characteristics of the device according to the invention.

A first example relates to pulse operation of the generator according to the invention, in the form shown in FIG. 2. The cylindrical wave guide has in its central portion a radius of approximately 5 mm and two rectangular and diametrically opposed extensions, proportioned in the manner shown in the drawing. An ordinary gun of this type supplies a beam of 1 Ampere accelerated at 10 kilovolts by anode 14.

The oscillator is a magnetron operating impulsively at a frequency of 16 gigahertz. It excites the guide with a power of 60 kW in which is established a field, whose lines of force on mode $TE_{10}$ are indicated by the solid line arrows. The value of the magnetic field is 0.6 Tesla and under these conditions the electron beam describes a spiral around the axis XX of the system located on a generally conical surface flaring in the transmission direction. It is modulated along its path and the modulated current has components at frequencies $n \times 16$ gigahertz. The lateral extensions preferentially guide one of these frequencies, specifically the frequency 80 GHz, on the same mode as the basic frequency. The maximum energy which it reaches is 60 kV at the end of 10 cycles. At 16 GHz, the guide length that is needed is approximately 4 cm, corresponding to a consumed power of 3 kW for a guide having a Q factor of 800, i.e. 5% of the power transferred to the electrons. Clusters are created within the cylindrical electron beam, whose diameter is 1.2 mm, while the radius of their orbit is 1.35 mm. The current component at harmonic 5 is, without other focussing means, approximately 0.21 $i_o$, $I_o$ being the current of the beam. The output power is 300 kW.

The other two examples relate to continuous operation of the generator according to the invention. The oscillator used at high frequency excitation is in these examples a klystron functioning at 10 GHz. The following Table gives the characteristics corresponding to two different excitation levels.

| | | |
|---|---|---|
| Excitation power (10 GHz) | 3.6 kW | 200 W |
| Injected beam | | |
| voltage | 2000 V | 100 V |
| current | 25 mA | 1 mA |
| Cavity length | 10 cm | 5.4 cm |
| Final transverse energy | 100 keV | 100 keV |
| Number of revolutions | 40 | 90 |
| Acceleration efficiency | 70% | 50% |
| Power produced (50 GHz) | 150 W | 6 W |
| Magnetic field | 0.43 Tesla | 0.43 Tesla |

As in the previous example the structure of the generator can be that of FIG. 2 using one and the same resonant cavity, the wave guide for the excitation frequency and its harmonic.

Thus, there has been described a generator, according to the invention, with a cylindrical wave guide and using a cylindrical electron beam. The generator according to the invention can also have a flat beam with a rectangular cross-section and wave guide, whose cross-section has the same configuration and whose width can be up to 1.5 times the length of wave $\lambda o$.

The beam can be supplied by a cathode, and accelerated by an anode, on entering the ultra-high frequency section, as in the example of FIG. 2. It can also be produced in a separate installation before entering the wave guide or the cavities of the generator, i.e. in the ultra-high frequency part. Such an installation is for example a betatron, a storage ring, etc.

The generator according to the invention has the same applications as prior art generators for millimeter waves, namely measurements in plasma installations, radar transmission systems, telecommunications, etc.

The invention is not limited to the embodiments described and represented herein and various modifications can be made thereto without passing beyond the scope of the invention.

What is claimed is:

1. A radio wave generator for ultra-high frequencies having an electron beam transmitted along an axis subject to the action of a magnetic field directed along said axis and to an electromagnetic field of resonant cavities arranged along said axis, wherein it comprises, coupled to said resonant cavities, means for applying a wave source at a frequency equal to the cyclotron frequency of the electrons of the beam in the magnetic field, and means for connecting to an output load in which energy is picked up at a frequency, called adjacent frequency, close to a multiple of said cyclotron frequency, and wherein the resonant cavities comprise a single cylindrical guide, whose cross-section is deformed in such a way as to have two diametrically opposed extensions of rectangular cross-section, and is coupled to the sources means at one of its ends and to the load means at the other.

2. A radio wave generator according to claim 1, wherein the magnetic field has a value which varies along the transmission axis.

* * * * *